US007048587B2

(12) United States Patent
Saller et al.

(10) Patent No.: US 7,048,587 B2
(45) Date of Patent: May 23, 2006

(54) FUSE HOLDER FOR BLADE-TYPE FUSES

(75) Inventors: Robert Saller, Egglkofen (DE); Bruno Betti, Maiocca Di Codogno (DE); Stefan Ecker, Vilsbiburg (DE); Paulus Bayer, Nassenfels (DE)

(73) Assignees: Lisa Draxlmaier GmbH, Vilsbiburg (DE); Audio Ohm Di Tonani Caterina E C. S.N.C., Maioccadi Codogno (IT); Audi AG, Ingolstandt (DE)

( * ) Notice: Subject to any disclaimer, the term of this patent is extended or adjusted under 35 U.S.C. 154(b) by 0 days.

(21) Appl. No.: 11/073,582

(22) Filed: Mar. 8, 2005

(65) Prior Publication Data

US 2005/0215123 A1 Sep. 29, 2005

(30) Foreign Application Priority Data

Mar. 9, 2004 (DE) ..... 10 2004 011 490

(51) Int. Cl.
*H01R 13/68* (2006.01)

(52) U.S. Cl. ..... 439/621; 439/723

(58) Field of Classification Search ..... 439/621, 439/830, 723, 76.2, 250, 949; 337/186
See application file for complete search history.

(56) References Cited

U.S. PATENT DOCUMENTS 4,460,239 A 7/1984 Inoue et al.
5,088,940 A * 2/1992 Saito ..... 439/621
5,474,475 A * 12/1995 Yamaguchi ..... 439/621
2002/0081905 A1* 6/2002 Nakamura et al. ..... 439/621

FOREIGN PATENT DOCUMENTS

| | | | |
|---|---|---|---|
| DE | 0 162 694 | A2 | 11/1985 |
| DE | 0 339 846 | A2 | 11/1989 |
| DE | 44 13 880 | C1 | 4/1995 |
| DE | 196 38 972 | A1 | 4/1998 |
| DE | 44 47 731 | C2 | 6/1999 |
| DE | 199 24 911 | A1 | 12/1999 |
| DE | 203 16 994 | U1 | 2/2004 |
| JP | 09 213 199 | | 8/1997 |

* cited by examiner

*Primary Examiner*—Tho D. Ta
(74) *Attorney, Agent, or Firm*—Sughrue Mion, PLLC

(57) ABSTRACT

The present invention relates to a fuse holder (1) having an oblong, box-shaped housing (2) comprising plug-in sites for blade-type fuses accessible from one top side of the housing, as well as contact chambers (6) for individual contacts arranged below the plug-in sites in the housing, and a contact channel (7) for a current bridge (8) arranged below the plug-in sites in the housing, wherein the chambers for the individual contacts, based on the axis of the longitudinal extension, are arranged in the housing offset relative to each other and on both sides of the longitudinal axis and wherein the contact channel for the current bridge extends substantially in the zigzag form along the longitudinal axis between the chambers for the individual contacts.

6 Claims, 4 Drawing Sheets

FUSE HOLDER FOR BLADE-TYPE FUSES

The present invention relates to a fuse holder having an oblong, box-shaped housing comprising plug-in sites for blade-type fuses accessible from a top side of the housing, as well as contact chambers for individual contacts arranged below the plug-in sites in the housing and a contact channel for a current bridge.

Fuse holders of this type are used in low-voltage units in the field of automotive engineering. The dimensions of the oblong housings are "standardized", in order that a number of fuse holders corresponding to the number of required plug-in sites can be combined and mounted side by side and subsequently in a so-called fuse box in a space as close as possible.

The above-indicated standard for the oblong housing is an internal standard of various automobile manufacturers which allows a modular structure with additional fuse holders. Such a modular structure e.g. allows that several fuse holders are combined to form a block in a space-saving arrangement.

The width and different further dimensions are predetermined in this standard, while the fuse holders may have another length. This allows that fuse holders having a different number of blade-type fuses (e.g. quadripolar fuse strips or dodecapolar fuse strips) can be combined with each other.

Fuse holders of this type are hitherto used for blade-type fuses of the form C (see DIN 72581-3). The dimensions of the housings are adapted to this kind of blade-type fuses. The blade-type fuses are mounted in the plug-in sites laterally to the longitudinal axis one behind the other, so that a plurality of blade-type fuses of the form C can be accommodated and the smallest possible space is thereby consumed.

Fuse holders of this type are also suited for blade-type fuses of the form F. The fuses of the form F are somewhat smaller, i.e. regarding width, height and length, than the fuses of the form C. For this reason, blade-type fuses of the form F may be mounted in the respective plug-in sites analogously to the blade-type fuses of the form C laterally to the longitudinal axis of the fuse holder.

In addition to the blade-type fuses of the form C and F, blade-type fuses of the form E are also used in automotive engineering (the so-called maximum-size fuses). This fuse-type needs fuse holders of its own having greater dimensions, which do not fit the standardized raster measure for fuse holders for blade-type fuses of the form C or F and, therefore, additional space must be provided in the respective fuse box.

It is therefore the object of the present invention, to provide a space-saving mounting possibility for blade-type fuses of the form E.

According to the invention, this technical object is achieved in that the chambers for the individual contacts are mounted offset to each other and on both sides of the longitudinal axis, in relation to the axis of the longitudinal extension in the housing, and that the contact channel for the current bridge extends substantially in zigzag form along the longitudinal axis between the chambers for the individual contacts.

Based on the arrangement and alignment of the blade-type fuses of the form C or F laterally to the longitudinal axis, a very advantageous design results for the housing of the fuse holder. The chambers for the individual contacts for the blade-type fuses of the form C or F can thus be mounted one after another on one side of the housing—in relation to the longitudinal direction of the housing—whereby an oblong continuous contact channel for the current bride on the other side of the housing is obtained, which can thus be designed in a very simple manner.

The invention is based on the idea to provide, by a reorganisation of the arrangement of the chambers for the individual contacts and the contact channel for the current bridge, a possibility that blade-type fuses of the form E can also be accommodated in a standardized housing for blade-type fuses of the form C or F and, therefore, a separate fuse holder for blade-type fuses of the form E can be omitted.

Since blade-type fuses of the form E cannot be arranged laterally to the longitudinal direction of the housing because of their length, they must be arranged in the longitudinal direction only and, therefore, an arrangement of the current bridge beneath the plug-in sites in the housing did no longer appear to be possible for lack of space.

According to the invention, however, a contact channel running in the zigzag form along the longitudinal axis of the housing surprisingly results from an offset arrangement of the chambers for the individual contacts on both sides of the housing, in which the current bridge can be arranged without functional disadvantages when it is correspondingly designed in the zigzag form.

In other words, in contrast to the known housings for blade-type fuses of the form C or F, the chambers for the individual contacts are not mounted on one side and in one row, but each at a distance to each other and on both sides of the housing, the arrangement of the chambers being made such that one chamber for an individual contact is always opposed by a gap on the other side. This gap is positioned in the central area of the housing between two chambers for individual contacts, while it is bordered at the respective housing end on the one side by a chamber for an individual contact and on the other side by the wall of the housing. This results in a zigzag form or a diagonally offset arrangement of the chambers and, consequently, in a contact channel for the current bridge also running in the zigzag form about the longitudinal axis.

This arrangement allows for the first time that blade-type fuses of the form E can also be mounted in a standardized fuse holder for blade-type fuses of the form C or F. Consequently, separate fuse holders for blade-type fuses of the form E are no longer required.

Since the standardized longitudinal extension of the housing of the fuse holder is greater than the length of two blade-type fuses of the form E, at least at one end of the housing remains still space for the arrangement of additional blade-type fuses of the form C or F, which results in an optimum exploitation of space.

To this end, is it advantageous that the box-like housing has a section with chambers for the individual contacts which are offset relatively to each other, and at least one section having chambers for individual contacts which are arranged adjoining on one side.

For safety reasons it is advantageous that the contact channel for the current bridge can be closed on the bottom side of the housing by a current bridge cover.

DESCRIPTION OF THE FIGURES

The invention will be explained in the following in more detail by means of the FIGS. 1 to 5. In addition to the prior art, the Figures show a preferred embodiment of the invention, in which

FIG. 1 is a drawing showing the principle of a fuse holder 1*a* according to the prior art. As may be taken from the section shown, the housing 2 has numerous contact chambers 6 for individual contacts and a contact channel 7. In the known fuse holder 1*a*, the chambers for the individual contacts 6 are arranged laterally to the longitudinal axis and they are disposed in a row on one side of the housing 2. In this known construction, the contact channel 7 is disposed on the other side of the housing 2 and extends substantially parallel to the longitudinal axis of the housing 2 which is indicated by an arrow in FIG. 1.

FIG. 2 is a drawing showing the principle of a preferred embodiment of a fuse holder 1 of the invention. The housing 2 of the fuse holder 1 has two separate sections A, B. In section A, blade-type fuses of the form E can be arranged, while section B serves for receipt of blade-type fuses of the form C or F. Both sections A, B have chambers for individual contacts 6 and a contact channel 7.

Figure 1:
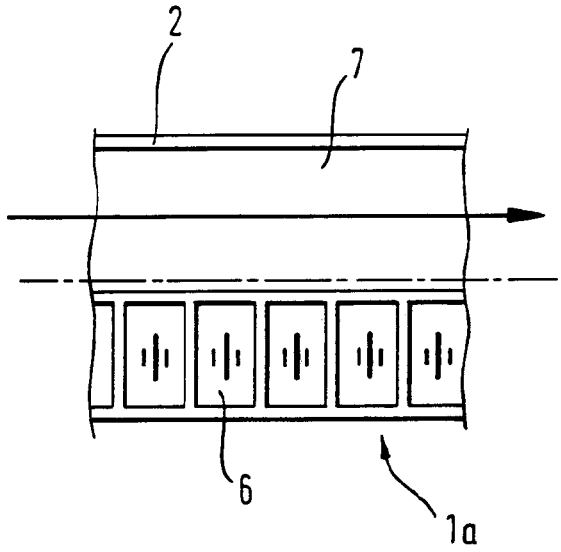
FIG. 1 is a drawing showing the principle of a fuse holder according to the prior art.

In section A, the chambers of the individual contacts 6 are arranged on both sides of the housing and extend in parallel to the longitudinal axis of the housing 2. In relation to the axis of the longitudinal extension, the contact chambers 6 in the housing 2 are offset to each other so that a gap always opposes a chamber 6 on one side, i.e., a section of the contact channel 7 on the other side. Due to the arrangement of the contact chambers 6 of the invention, the contact channel 7 thus extends substantially in a zigzag form or in a meander form along the longitudinal axis of the housing 2 which is indicated by a double arrow in FIG. 2.

Figure 2:
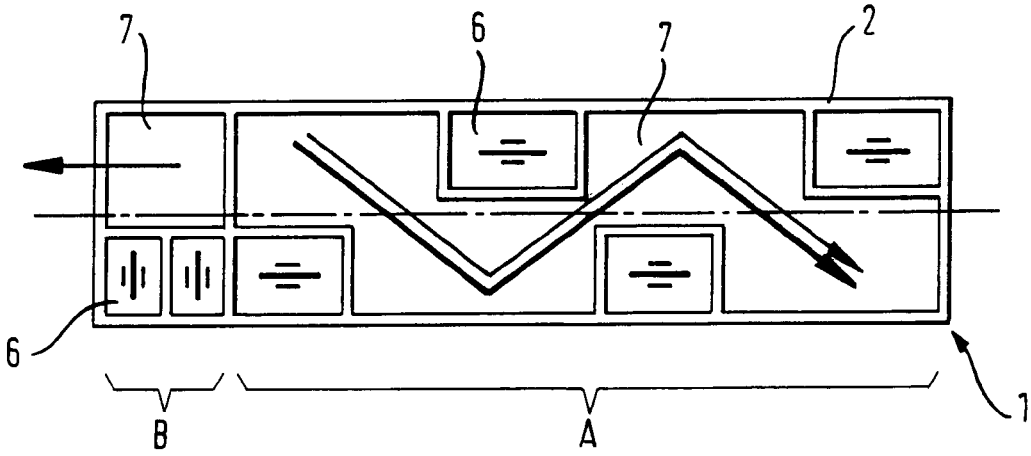
FIG. 2 is a drawing showing the principle of a fuse holder according to a preferred embodiment of the invention.

In section B of the fuse holder 1 according to the invention shown in FIG. 2, the contact chambers 6 and the contact channel 7 are accommodated in the conventional manner, which is already in detail described with reference to FIG. 1.

Figure 3A:
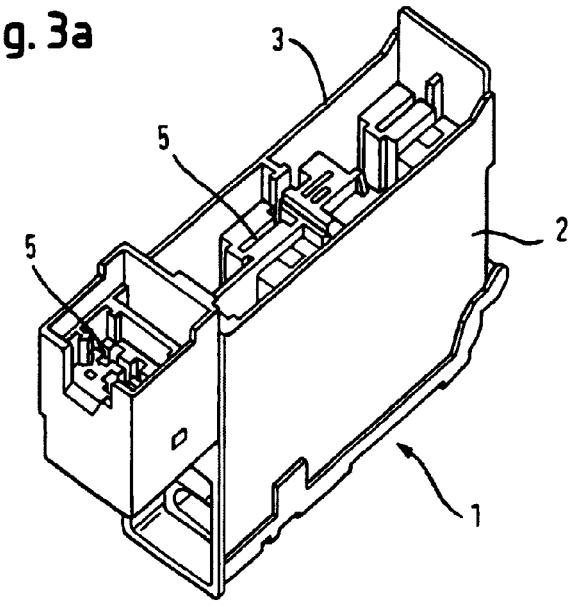
FIG. 3*a* shows the fuse holder according to the invention in a perspective view from above.

In FIG. 3*a* shows a perspective view from above onto a preferred embodiment of the fuse holder 1 according to the invention. Several plug-in sites 5 for blade-type fuses are provided at the top 3 of the housing 2 which are not shown in FIG. 3*a* for reasons of clarity. As already mentioned, due to the design of the fuse holder 1 according to the invention, apart from blade-type fuses of the form E, blade-type fuses of the form C or F can also be accommodated on the fuse holder 1. The blade-type fuses of the form E are accommodated in section A of the fuse holder 1. As compared therewith, blade-type fuses of the form C or F are preferably accommodated at one end of the housing 2, in the section B, as may be taken from FIG. 3*b*.

Figure 3B:
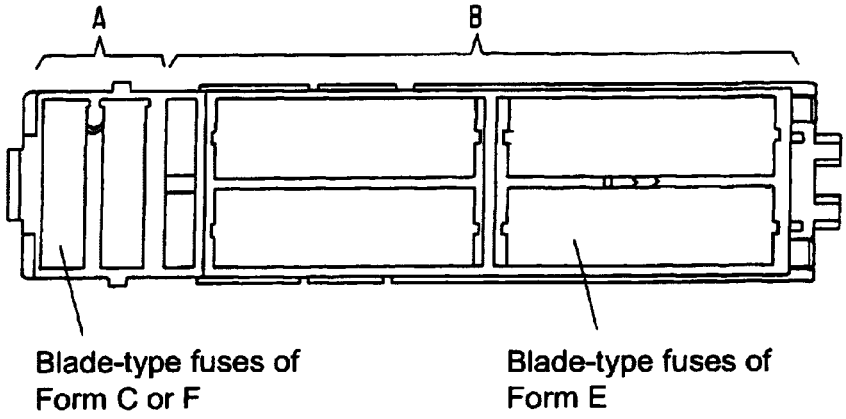
FIG. 3*b* shows a view of the top of the fuse holder according to the invention with the blade-type fuses mounted.

The different arrangement of the various forms of blade-type fuses in the housing 2 of the fuse holder 1 is clearly revealed in FIG. 3*b*: blade-type fuses of the form E are accommodated in parallel to the longitudinal axis of the housing 2 while blade-type fuses of the form C or F are accommodated laterally to the longitudinal axis of the housing 2. Thus, the arrangement of the blade-type fuses of the form E according to the invention allows that they are accommodated in a "standardized" fuse holder 1 for blade-type fuses of the form C or F. Consequently, it can be done without an additional fuse holder 1 for fuses of the form E.

Figure 4:
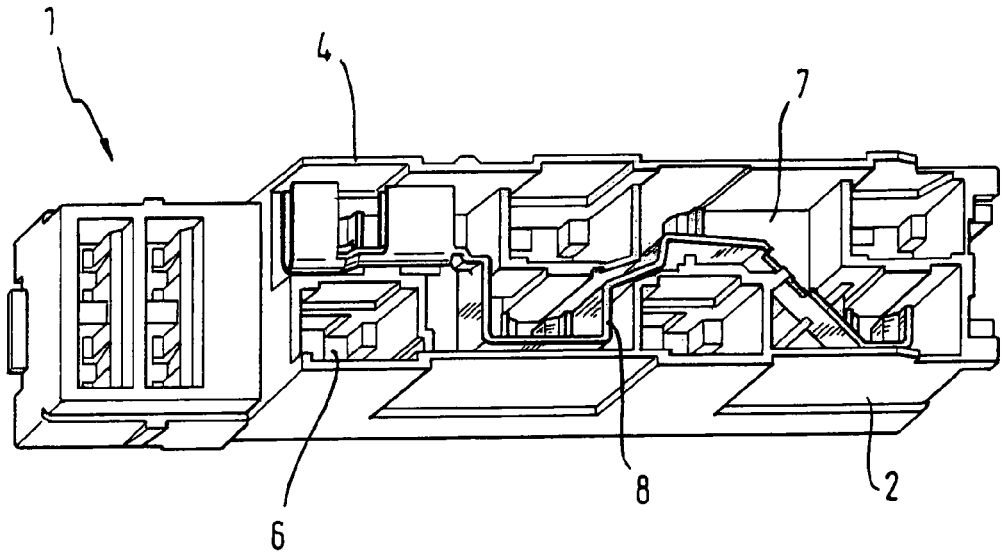
FIG. 4 shows a perspective view of the bottom side of the fuse holder according to the invention as shown in FIG. 3*a*.

FIG. 4 shows a perspective view of the bottom side 4 of the fuse holder 1 according to the invention. As may clearly be recognized from FIG. 4, each contact chamber 6 on one side of the housing 2 is opposed by one section of the contact channel 7 on the other side of the housing 2. This offset arrangement of the chambers of the individual contacts 6 leads to a substantially zigzag-shaped run of the contact channel 7. In FIG. 4, further a current bridge 8 is revealed the form of which is adapted to the meander-shaped run of the contact channel 7.

Figure 5A:
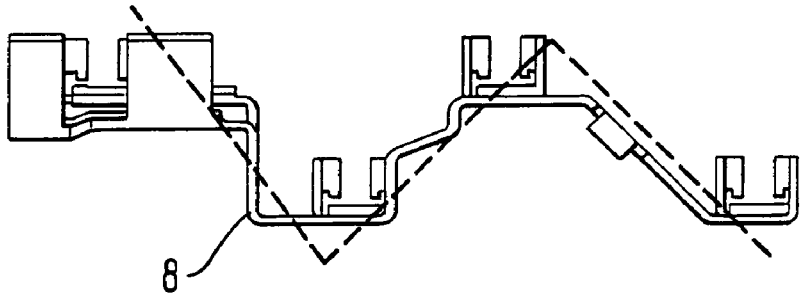
FIG. 5*a* shows a plan view onto a current bridge.

FIG. 4 shows the current bridge 8 in the housing 2 of the fuse holder 1 in the mounted state in accordance with FIGS. 3*a* and 3*b*. In order to show the design of the zigzag-shaped current bridge 8 more clearly, it is also represented separately as a plane view (see FIG. 5*a*). The current bridge 8 consists of a metal sheet which is formed in accordance with the zigzag-shaped run of the contact channel 7. In addition, the zigzag-shaped run of the current bridge 8 already mentioned is clearly shown in FIG. 5*a* by dashed lines. Further details of the current bridge may be taken from FIG. 5*b*.

Figure 5B:
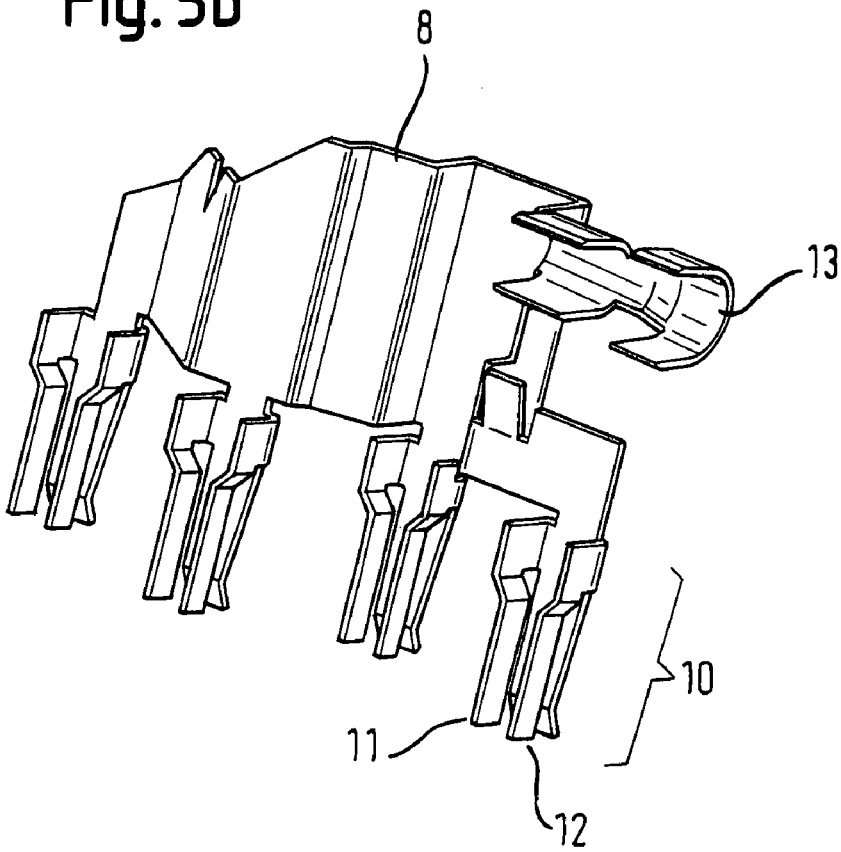
FIG. 5*b* shows a perspective lateral view of the current bridge.

FIG. 5*b* shows a perspective lateral view of the current bridge 8. As may be taken from FIG. 5*b*, the current bridge 8 connects several fuse contacts 10 serving for a connection to the respective blade-type fuses (not shown). Each fuse contact 10 is designed as a single-blade contact and each fuse contact 10 has a stop leg 11 and a spring leg 12 preferably preloaded against the stop leg 11. A connection of the blade-type fuses to the fuse contacts 10 can be performed by inserting the respective blade-type fuse between the respective stop leg 11 and the spring leg 12 of an individual spring contact 10. The current bridge 8 further has a current conductor 13 which serves for receipt of an electric line and for the friction-type connection thereto (not shown).

The contact channel 7 for the current bridge 8 can be closed at the open bottom side 4 of the housing 2 by a current bridge cover (not shown). For safety reasons, the current bridge cover is preferably made of an electrically non-conductive material such as e.g. a synthetic material. In addition, the current bridge cover preferably has a Z-form in order that only the current bridge 8 is covered which lies in the contact channel 7, but not the area of the contact chambers 6 for the individual contacts.

The invention claimed is:

1. Fuse holder (1) having an oblong, box-shaped housing (2), comprising plug-in sites (5) for blade-type fuses accessible from one top side (3) of the housing, as well as contact chambers (6) for individual contacts arranged below the plug-in sites in the housing and a contact channel (7) for a current bridge (8) arranged below the plug-in sites in the housing, characterized in that the chambers (6) for the individual contacts, in relation to the axis of the longitudinal extension in the housing (2), are offset relative to each other and arranged on both sides of the longitudinal axis, and that the contact channel (7) for the current bridge (8) extends substantially in zigzag form along the longitudinal axis between the chambers (6) for the individual contacts.

2. Fuse holder according to claim 1, characterized in that, in relation to the axis of the longitudinal extension, one chamber (6) for an individual contact is opposite one gap on the other side.

3. Fuse holder according to claim 2, characterized in that the gaps between two chambers (6) on one side are connected to the adjacent gaps on the other side.

4. Fuse holder according to claim 1, 2 or 3, characterized in that the gaps connected to each other form the contact channel (7) for the current bridge (8) running in the zigzag form.

5. Fuse holder according to claim 1, characterized in that the box-like housing (2) has a section (A) having chambers (6) for individual contacts which are arranged offset relative to each other on both sides and at least one section (B) having chambers for individual contacts which are arranged adjoining on one side.

6. Fuse holder according to claim 1, characterized in that the contact channel (7) for the current bridge (8) can be closed on the bottom side of the housing (4) by a current bridge cover.

* * * * *